US005348237A

United States Patent [19]

Halbedel et al.

[11] Patent Number: 5,348,237

[45] Date of Patent: Sep. 20, 1994

[54] APPARATUS FOR REDUCING, DISPERSING WETTING AND MIXING PUMPABLE, NON-MAGNETIC MULTIPHASE MIXTURES

[75] Inventors: Bernd Halbedel, Ilmenau; Walter Mueller, Leipzig; Rolf Baudrich, Rueckmarsdorf; Dagmar Huelsenberg, Ilmenau, all of Fed. Rep. of Germany

[73] Assignee: Herberts Industrielacke GmbH, Leipzig, Fed. Rep. of Germany

[21] Appl. No.: 809,441

[22] Filed: Dec. 19, 1991

[30] Foreign Application Priority Data

Apr. 25, 1991 [DE] Fed. Rep. of Germany ..... 4113490

[51] Int. Cl.[5] ..... B02C 17/10

[52] U.S. Cl. ..... 241/67; 241/172; 241/184

[58] Field of Search ..... 241/170, 172, 65, 67, 241/184

[56] References Cited

U.S. PATENT DOCUMENTS

| | | | |
|---|---|---|---|
| 3,219,318 | 11/1965 | Hershler . | |
| 3,398,902 | 8/1968 | Khomeriki | 241/170 |
| 3,423,880 | 1/1969 | Hershler . | |
| 3,987,967 | 10/1976 | Kuznetsov et al. | 241/170 X |
| 4,059,232 | 11/1977 | Engels | 241/67 X |
| 4,134,553 | 1/1979 | Steinort et al. | 241/170 x |
| 4,134,557 | 1/1979 | Lazzari et al. | 241/170 |
| 4,174,074 | 11/1979 | Geiger | 241/67 X |
| 4,304,362 | 12/1981 | Bühler | 241/67 |
| 4,601,431 | 7/1986 | Watanabe et al. . | |
| 4,632,315 | 12/1986 | Watanabe et al. . | |
| 4,632,316 | 12/1986 | Watanabe et al. . | |
| 4,915,307 | 4/1990 | Klimaschka et al. | 241/172 X |
| 4,919,347 | 4/1990 | Kamiwano et al. | 241/65 |
| 4,948,056 | 8/1990 | D'Errico | 241/67 |
| 4,995,730 | 2/1991 | Abrosimove et al. . | |

FOREIGN PATENT DOCUMENTS

| | | | |
|---|---|---|---|
| 888641 | 7/1949 | Fed. Rep. of Germany . | |
| 240674B1 | 7/1989 | Fed. Rep. of Germany . | |
| 480447 | 10/1975 | U.S.S.R. . | |
| 662144 | 5/1979 | U.S.S.R. . | |
| 808146 | 3/1981 | U.S.S.R. . | |
| 906613 | 2/1982 | U.S.S.R. | 241/172 |
| 908389 | 3/1982 | U.S.S.R. . | |
| 995221 | 2/1983 | U.S.S.R. . | |
| 1203573 | 6/1983 | U.S.S.R. . | |
| 1045927 | 10/1983 | U.S.S.R. . | |
| 1103897 | 7/1984 | U.S.S.R. . | |
| 1554966 | 4/1990 | U.S.S.R. | 241/172 |
| 1570934 | 2/1977 | United Kingdom . | |

*Primary Examiner*—Mark Rosenbaum
*Assistant Examiner*—Frances Chin
*Attorney, Agent, or Firm*—Foley & Lardner

[57] ABSTRACT

An apparatus for reducing, dispersing, wetting and mixing pumpable, non-magnetic multiphase mixtures comprises a sealed annular-gap chamber having an annular gap which forms a working chamber, into which the material to be worked flows in from the bottom and flows out from the top. This annular-gap chamber is formed by a double tube, the outer tube of which is surrounded by an outer exciter system and the inner tube of which is surrounded by an inner exciter system. In the working chamber there are, apart from the material to be worked, freely mobile magnetic working media, which move in the direction of the rotating electromagnetic fields within the multiphase mixture flowing through the annular-gap chamber and perform translatory transverse motions and tumbling motions. Within the working chamber or the annular gap there exist an inflow zone and an outflow zone, which are in each case free from working media.

27 Claims, 3 Drawing Sheets

APPARATUS FOR REDUCING, DISPERSING WETTING AND MIXING PUMPABLE, NON-MAGNETIC MULTIPHASE MIXTURES

BACKGROUND OF THE INVENTION

The invention relates to a process and an apparatus for reducing, dispersing, wetting and mixing pumpable, nonmagnetic multiphase mixtures by means of electromagnetic energy, which acts on magnetic working media within substances in a closed volume, the working media moving differently under the influence of an electromagnetic field, changing in location and/or over time.

In the case of processing materials by reducing—in particular by fine and ultrafine reduction of granular substances—and/or by mixing, dispersing and/or agitating powders, liquids and gases, at the forefront is the fact that as large a contact surface or surface of the interacting phases as possible has to be generated, since this shortens the duration of processing and reduces the temperature gradient and concentration gradient in the processing volume.

As is known, various technical designs of agitator ball mills are used for the process-engineering steps such as reducing, (deagglomerating), dispersing, wetting and mixing of pumpable, non-magnetic multiphase mixtures.

In the case of this preparation technique, the energy used is transferred to the multiphase mixtures only indirectly via a plurality of intermediate stages, beginning with the electric drive, via a rotating agitator and one or more grinding media. This results in high energy losses, which have to be led away as thermal losses via complex cooling systems.

Furthermore, on the material-discharge side of the working space, additional separating means, such as screens, edge filters etc., and shaft sealing systems are necessary, which are subjected to high material wear.

Also known are apparatuses and processes for mechanically preparing granular substances and/or for mixing and agitating powders, liquids and gases by the use of electromagnetic fields. Here, the electric energy fed to a stationary main element by means of electromagnetic fields is converted directly into mechanical energy of freely moving ferromagnetic working media. The stationary main element is, for example, an electrical exciter arrangement, which bears an exciter winding, and which has an air-gap space.

German Offenlegungsschrift 2,556,935 discloses a material working process for powders, liquids, gases and their mixtures as well as an apparatus for carrying out the process, in which the material to be worked is introduced into a chamber together with magnetic elements of hard-magnetic material, which move chaotically under the influence of an electromagnetic alternating field. The alternating field is generated by means of an electric exciter winding in a space in which the chamber is arranged. In this arrangement, the exciter winding surrounds the chamber. The magnetic elements are arranged in the chamber in a layer of predetermined thickness, the thickness being determined by the operating conditions of the magnetic field, the size of the magnetic elements, their density and their magnetic variables such as induction and coercive force as well as by the force of gravity.

In other material working processes, such as are described in U.S. Pat. Nos. 3,219,318, and 3,423,880, hard-magnetic ferromagnetic elements and magnetic alternating fields, in particular pulsating magnetic fields, are used.

In the case of these processes, first of all the material to be worked, of any form, is introduced into a chamber, and thereafter the ferromagnetic elements of a hard-magnetic material. Then, the chamber is put into a space in which a magnetic alternating field is generated. The magnetic field sets the ferromagnetic elements into a chaotic motion, in which they rotate about their axes and collide with one another, whereby the material is correspondingly worked.

In the processes according to the patents mentioned, the magnetic elements are produced from a hard-magnetic material with a coercive force of over 50 Oersted and have a non-spherical shape. Their average size lies in the range of at least a few tenths of a micrometer to at most 2.5 cm. The magnetic field strength of the alternating field is over 0.01 Oersted and its frequency is up to 1 MHz.

These processes serve for working substances in a periodic and uninterrupted operating sequence in small vessels, boxes, tubes or capillaries as well as for grinding surface locations where access is difficult.

The apparatuses with which said working processes are implemented include an electric solenoid winding and a working chamber of a non-magnetic material, arranged in the inner or outer space of the solenoid coil, in which a sinusoidal magnetic alternating field is generated. The magnetic elements introduced into the chamber, which are of barium hexaferrite or an "Alnico-8" alloy or iron-cobalt-nickel-aluminum alloy, of indeterminate form, effect by their motions under the influence of the magnetic field a mixing or reducing of the material being worked. The number of magnetic elements in the chamber is chosen such that they are at sufficiently great distances from one another during their motions in the chamber and do not wear one another down, this number being smaller than the number of elements in the case of their single-layer arrangement on the entire bottom surface of the chamber.

A disadvantage of the known processes is the low energy density which is introduced into the processing operations, due to the relatively small number of magnetic elements per unit volume of the working chamber. Consequently, great energy requirements arise, since there is not utilization of the entire volume of the magnetic field, per unit of the worked product, which causes the working of the material to be more expensive. It is found that an increase in the number of magnetic elements in the working chamber on the one hand results in great wear of the elements, whereby the product being worked is contaminated and the costs of the working increase on account of the high consumption of the expensive magnetic media, and on the other hand the lower-lying magnetic elements move less intensively than the upper elements, as a consequence of the force of gravity of the upper elements acting on the lower-lying elements.

In the known working apparatuses, an air-gap space is available as working space. In it there is a multiplicity of ferromagnetic working media, which act in the conventional sense as grinding media, and the substances or multiphase mixtures to be prepared.

For the exciter systems, in general three different types are used:

(1) Concentric alternating field exciter systems with single-phase fed ring or solenoid windings as are described, for example, in the following printed publications: Soviet Patent 480,447, German Offenlegungsschrift 2,556,935, Soviet Patent 662,144, Soviet Patent 837,411, Soviet Patent 908,389, German Offenlegungsschrift 3,843,368 U.S. Pat. No. 4,995,732;

(2) Linear single-sided and two-sided travelling-field exciter systems with multiphase fed phase windings according to, for example, the following printed publications: Soviet Patent 995,221, Soviet Examined Patent Application 1,023,573, German Offenlegungsschrift 3,233,926, U.S. Pat. No. 4,601,431, German Offenlegungsschrift 3,240,021, U.S. Pat. No. 4,632,318, German Offenlegungsschrift 3,240,057, U.S. Pat. No. 4,632,316, Soviet Examined Patent Application 1,103,887; and (3) Rotationally symmetrical single-sided and two-sided rotating-field exciter systems such as are known from, for example, the following printed publications: German Patent 888,641, British Patent 1,570,934, Soviet Patent 808,146, Soviet Examined Patent Application 1,045,927, German Offenlegungsschrift 3,233,926, U.S. Pat. No. 4,601,431, and East German Patent 240,674.

In the case of alternating field exciter systems with single-phase fed ring or solenoid windings, the space enclosed by the winding is fully available as a working space for working the material. Ferromagnetic components are not required for guidance of the exciter field.

However, on the other hand there is first of all the necessary extra winding material used to ensure adequate working space field strengths and problems in leading away the current heat losses from the compact ring coils. The low heat transfer to the surroundings and the limited heat absorption capacity of the stream of material which apply in this case always require additional measures for adequate loss removal which, on the one hand, ensures that the magnetic characteristic values of the working media are not substantially reduced and, on the other hand, ensures that the material to be prepared does not heat up to above specified limit temperatures.

Furthermore, the exciter field B (x, t) in this case represents a pure alternating field $$B(x,t)=\hat{B}\cdot\cos(2\pi\cdot f\cdot t) \quad (1)$$

where:

$\hat{B}$—amplitude f—frequency of the exciter current t—time

That means that at each location x of the working space only field changes of equal magnitude, that is changes over time, take place. They can also only bring about the same oscillatory or rotational motions of the working media.

To ensure the relative motions between the working media absolutely necessary for the mechanical loading of the substances to be prepared, (1) the working space must be filled virtually completely with working media, (2) certain classifications (size and/or shape) of the working media must be maintained, and (3) there must be graduation in the radial field strength distribution.

High degrees of filling with working media on the one hand limit significant dimensions of the preparation apparatus and consequently the material throughput, since the force of gravity and adhesion forces of the working media fix their maximum filling height (German Offenlegungsschrift 2,556,935). Beyond the critical filling height of the working media, inadequate working media motions are achieved, in particular in the lower regions. This results in a reduction in the energy input into the working space and in a reduction in the effectiveness of the working.

On the other hand, the high degrees of filling with working media bring about considerable wearing of the working media due to the frequent collisions of the working media.

In the case of alternating field exciter systems, it is functionally only possible for the required local field strength gradients to run radially inward. The field strength decreases exponentially over the inner extent of the exciter system. As a result, the motion of the working media, and consequently the effectiveness of the working, becomes less and less in the radially inward direction. Consequently, areas of dead space are possible in batch operation and it is possible for material to pass straight through in the case of continuous filling.

Designs with ring windings and solenoid windings are restricted to small diameter/length ratios and have low energy densities and low levels of efficiency.

The known linear travelling field exciter systems have a three-phase winding distributed in slots. For guidance and for ensuring penetration of the working space by the exciter field, a closed magnetic circuit of laminated sheet assemblies is required. The exciter field changes not only over time but also in location. The following applies for the fundamental wave:

$$B(x,t)=\hat{B}\cos\left(\frac{\pi}{\tau_p}x-2\pi\cdot f\cdot t+\rho_B\right) \quad (2)$$

where:

$\hat{B}$—Amplitude $\tau_p$—Pole pitch of the exciter arrangement f—Frequency of the exciter currents That is to say, in the working space there is a sinusoidal induction distribution, which moves at a constant rate $$v_0=2\tau_p\cdot f$$

This natural field movement brings about a transportation of the ferromagnetic content of the working space. Consequently, the working media shift within a short time to one of the two ends of the working chamber, build up there and hinder one another in their motion. As a result, the possible energy conversion and level of efficiency are markedly reduced. Distinctly poorer and less uniform preparing effects are obtained. To counteract this disadvantage, in principle two opposite travelling field exciter systems are used and additional measures are taken to make the motion of the working media less uniform:

(1) opposed connection of the exciter fields of the mutually opposite exciter systems over the entire length of the exciter system (Soviet Patent 995,221, German Offenlegungsschrift 3,233,926) or over certain sections (Soviet Examined Patent Application 1,023,573, Soviet Examined Patent Application 1,103,897);

(2) changing the distance between mutually opposite exciter systems over their length (German Offenlegungsschrift 3,233,926, Soviet Examined Patent Application 1,103,897);

(3) making the fields less uniform by various pole pitches, different feeding and dimensioning of the exciter windings of the mutually opposite exciter systems (German Offenlegungsschrift 3,233,926);

(4) fitting partition walls in the working space transversely to the direction of movement of the exciter field (German Offenlegungsschrift 3,233,926).

Although each of these measures brings about a reduction in the rate of transportation, it also brings about a significant reduction in the electromechanical energy conversion and consequently a deterioration in the level of efficiency. On the other hand, it involves considerable extra constructional and mechanical-engineering expenditure as well as increased expenditure on operational management and control as well as process-engineering handling.

In the case of rotating field exciter systems, in principle there are endless paths in the plane of the direction of movement of the field for the working media, since these exciter systems are self-contained.

In British Patent 1,570,934, an outer rotationally symmetrical rotating field exciter system and, for making the working media motion additionally less uniform, multiply polarized working media are used.

In the case of the known apparatus for reducing, mixing and agitating with opposite rotationally symmetrical rotating field exciter systems according to German Offenlegungsschrift 3,233,926, the disadvantage of this apparatus is that the directions of movement of the exciter fields of the outer system and of the inner system are opposed, and additional steps have to be taken for making the fields less uniform by variable pole pitches, magnetomotive forces and air-gap widths.

The constant, on average over time, translatory transporting movement is necessary in order to guarantee a steady-state electromechanical energy conversion in the working space of use for mechanical preparation. Therefore, as known from East German Patent 240,674—for intensive utilization of the electric energy supplied and for ensuring adequately great energy densities in the working space, it is only appropriate to design the exciter arrangement as opposite on two sides and self-contained, to design the working chamber as similarly self-contained and to make the dimensioning, connection and feeding of the exciter winding such that there is only a single direction of movement of the electromagnetic field penetrating the working chamber. This then produces endless paths for all the ferromagnetic constituents of the working chamber content, an effective energy conversion and corresponding preparation effects.

However, the self-containedness is accomplished in the direction of movement of the exciter field by an arrangement in series, provided with spaced intervals, of a plurality of geometrically finite exciter system parts.

Such an arrangement is suitable for the dry fine and ultrafine reduction of granular materials, but not for the mechanical preparation of pumpable multiphase mixtures.

SUMMARY OF THE INVENTION

An object of the invention is to improve a process of the type described at the beginning for preparing non-magnetic multiphase mixtures, such that the wear of the magnetic working media is to a great extent avoided, emissions from the working space are greatly reduced and the yield of ultrafine-worked multiphase mixtures is increased with a low expenditure of energy.

Another object of the invention is to provide an apparatus for preparing multiphase mixtures which has a simple constructional design and arrangement of the electromagnetic exciter systems and of the working chamber with optimum energy yield in comparison with the energy expenditure for the motion of the working media.

A further object of the invention is to provide an apparatus in which it is possible to set optimally an energy adapted to the process and that difficult dispersing processes can be carried out and difficult wetting and mixing conditions can be maintained.

According to a first aspect of the invention there is provided a method of reducing, dispersion, wetting and mixing pumpable, non-magnetic multiphase mixtures. A multiphase mixture is enclosed in a closed volume with a top, bottom, two sides, and an inlet region. Magnetic working media responsive to an electromagnetic field is placed within the volume. Two rotationally symmetrical self-contained exciter systems tangential to the volume surround it on two sides. An electromagnetic field is generated and changes over time, rotates in the same direction and penetrates the multiphase mixture in one direction. A stream of multiphase mixture is continuously fed to the volume through the inlet region at an angle of 90° with respect to the rotating electromagnetic field.

According to a second aspect of the invention, there is provided an apparatus for producing, dispersing, wetting and mixing .pumpable, non-magnetic multiphase mixtures. The apparatus includes an inner and outer tube, forming an annular-gap chamber. The chamber has an inflow and outflow zone, an inlet and outlet, and a top and bottom. The chamber is hermetically sealed, apart from the inlet and outlet. An outer exciter system surrounds the outer tube, and an inner exciter system surrounds the inner tube. A plurality of rotating electromagnetic fields are created by the exciter systems. A plurality of freely mobile magnetic working media are contained in the annular-gap chamber, but not in the inflow and outflow zones, and move in the direction of the rotating fields.

BRIEF DESCRIPTION OF THE DRAWINGS

The invention is explained in more detail below with reference to illustrative embodiments represented in the drawings, in which.

DETAILED DESCRIPTION OF THE PREFERRED EMBODIMENTS

According to the invention a multiphase mixture is surrounded on two sides by two rotationally symmetrical, self-contained exciter systems which are opposite each other at a constant distance, generate in each case an electromagnetic field which changes over time, rotates in the same direction and penetrates the multiphase mixture in one direction, and pass tangentially around the volume which the multiphase mixture takes up between the opposite exciter systems. A stream of multiphase mixture to be prepared is fed continuously to the volume at an angle of 90° with respect to the rotating electromagnetic field.

This takes place by an annular-gap chamber, hermetically sealed apart from the inlet and outlet, forming the working chamber and comprising a double tube, the outer tube of which is surrounded by an outer exciter system and the inner tube of which surrounds and is bordered by an inner exciter system. The working media move in the direction of the rotating fields of the exciter systems within the multiphase mixture flowing through the annular-gap chamber, and the inflow zone and the outflow zone for the multiphase mixture in the annular-gap chamber are free from working media.

Consequently, substantial energy savings of more than 50% in comparison with known processes can be achieved. Due to the extensive hermetic sealing of the apparatus, no emissions of pollutants can occur. Furthermore, the production, operating and maintenance costs are minimized by dispensing with any mechanical transfer systems and working media separating means. With controlled temperature and working media filling characteristics, it is possible to divide the apparatus up into a fully automated process control as an element of the pipeline system.

Figure 1:
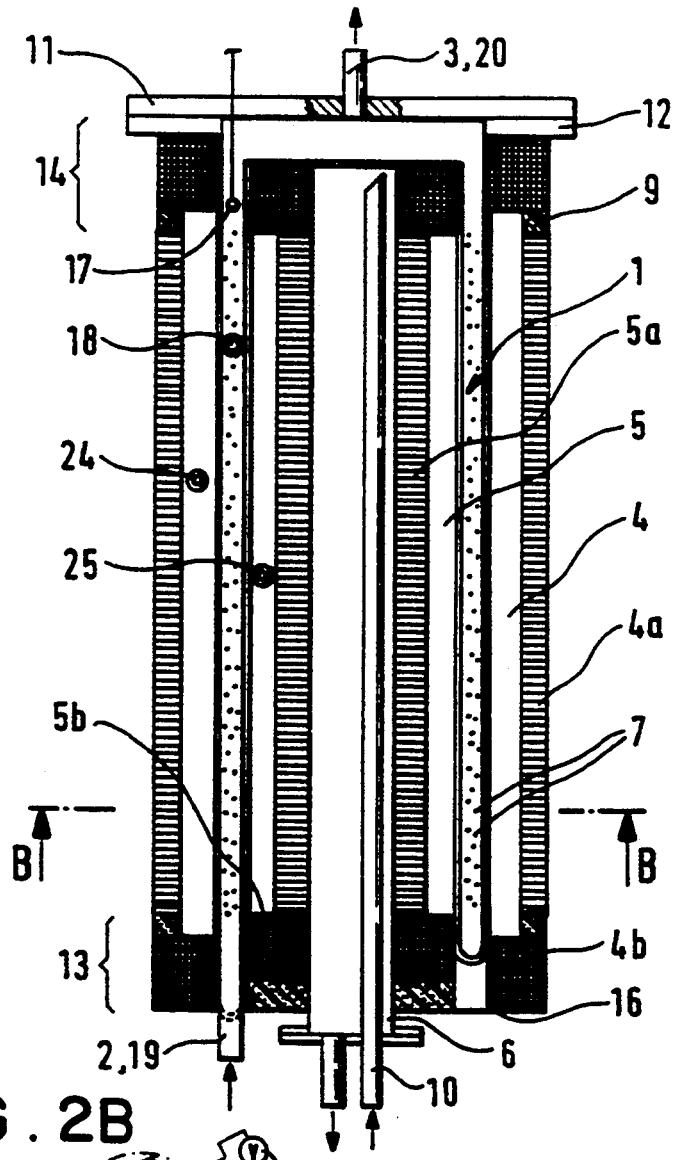
FIG. 1 shows the longitudinal section A—A of a first illustrative embodiment of an apparatus according to the invention.
Figure 2B:
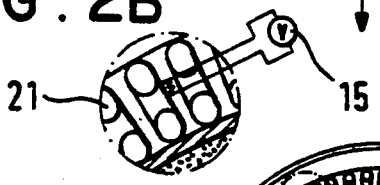
FIG. 2*b* is a plan view of the field coils according to FIG. 2*a;*
Figure 2A:
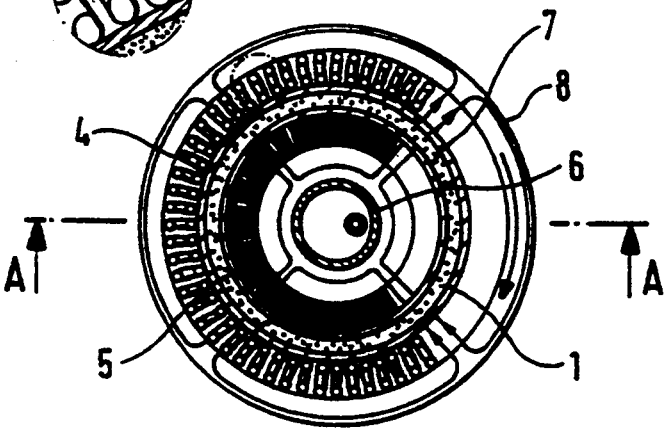
FIG. 2*a* shows a plan view in section B—B of the apparatus according to FIG. 1.

FIGS. 1 and 2 show sectional representations of a first embodiment of the apparatus according to the invention. An annular-gap chamber 1 comprises an outer tube, which is surrounded by an outer exciter system 4, and an inner tube, which surrounds and is bordered by an inner exciter system 5. "Bordered" is to be understood as meaning that the inner exciter system 5 forms the border of the inner tube. The apparatus has a working space. The working space of the annular-gap chamber 1 is an annular gap, having a bottom 16 which is beveled and is welded to an arched annular-gap plate. The upper termination of the annular gap chamber 1 is formed by a flange 12, which is bolted to a cover 11. Through the cover 11 there leads an outlet 3 of the annular gap to the outside. The annular-gap chamber 1 preferably consists of a non-ferromagnetic material. An inlet 2 for the multiphase mixture to be worked is arranged at the lowest point of a sloping bottom 16, which likewise consists of a non-ferromagnetic material. In the electromagnetically active working space of the annular-gap chamber 1 there are freely mobile magnetic working media 7, which move apparently chaotically, as described in further detail below, on endless paths at a rate which is constant over time along an electromagnetic field generated by the exciter systems 4, 5 and rotating in one direction, the multiphase mixture to be worked flowing through the working space, which mixture is fed into the annular-gap chamber 1 via the inlet 2 and flows out of the annular-gap chamber 1 via the outlet 3.

The two exciter systems 4, 5 are rotationally symmetrical and comprise sheet assemblies 4*a*, 5*a*, which are formed from individual sheets and exciter windings 4*b*, 5*b*, which are, for example, of three-phase design and are distributed in slots of the sheet assemblies 4*a*, 5*a*. The sheet assemblies 4*a*, 5*a* bear these exciter windings, which are equipped with the same number of pairs of poles. The exciter windings 4*b*, 5*b* are fed from a three-phase system and are interconnected in such a way that there is an electromagnetic field 8 which rotates, changes over time, passes through the annular gap in a radial direction and runs along the sheet assemblies tangentially, i.e. along the circumference. The exciter windings 4*b*, 5*b* and the sheet assemblies 4*a*, 5*a* of the exciter systems 4, 5 are preferably cast in a solvent-resistant resin 9 and completely surrounded by the latter, so that there is a good heat transfer from the exciter windings to the sheet assemblies of the respective exciter systems and, furthermore, protection is provided for the exciter systems against harmful solvent effects, possible in the event of failure.

The inner exciter system 5 has a cylindrical free space running axially right through it, whereby the heat loss occurring in the inner exciter system 5 and the heat loss occurring as a result of the preparation process in the annular-gap chamber 1 are carried away, for example, via a central heat sink 6, which the annular-gap chamber 1 encloses in such a way that the sheet assembly 5*a* of the inner exciter system 5 is in direct contact with the heat sink 6. The heat sink 6 advantageously comprises a non-ferromagnetic tube inserted into the cylindrical free space of the inner exciter system 5 and closed at the top, in the inside of which tube there is introduced a cooling tube 10, through which a liquid or gaseous coolant flows from below into the heat sink 6. This coolant flows downward out of the heat sink 6 through an outflow tube.

The annular-gap chamber 1 is designed as a unit which can be separated from at least one of the outer and inner exciter systems 4, 5 and can be withdrawn from them in the upward or downward direction.

The exciter systems 4, 5 lie opposite each other and can be switched on independently of each other. They are arranged in such a way that there develops an electromagnetic field which rotates and changes over time, in which the already-mentioned working media 7 of a hard-magnetic material, for example hexaferrites, move. The intensity of the electromagnetic field 8 and its rotational guidance are adapted to the requirements of the material to be worked. Since the annular-gap chamber 1 is hermetically sealed off to a great extent, the complete apparatus is emission-free between the inlet 2 and the outlet 3.

The working media 7 are ball-shaped or barrel-shaped, having a diameter or length, respectively, of 1.0 to 4.0 mm. The packing density of the working media 7 within the annular gap, i.e., the electromagnetically active working space of the annular-gap chamber 1, lies in the range from 40 to 90% by volume. In the region of the inlet 2 there lies an inflow zone 13, which is free from working media 7. In the region of the outlet 3 there is an outflow zone 14, having a cross-section which increases in the direction of the outlet 3 and, just like the inflow zone 13, is free from working media 7.

The pumpable multiphase mixtures may be, for example, dispersions and suspensions, primarily for dyestuff reducing operations.

As already mentioned above, when considered macroscopically, the working media 7 apparently move chaotically on endless paths in the electromagnetic field 8 which is generated by the two exciter systems 4, 5. Seen microscopically, the paths of the working media are produced by the superposing of:

- translatory motions in and against the direction of movement of the exciter field, i.e. of the electromagnetic field 8,
- translatory motions transversely to the direction of movement of the exciter field,
- rotating and tumbling motions about the axes of the media, as well as
- a superposed rotational motion, constant on average over time, in the direction of the exciter field.

The stream of material to be prepared is fed in continuously from below at an angle of 90° with respect to the plane of rotation of the exciter field and, after flowing through the annular gap of the annular-gap chamber 1, is carried away again without additional collecting means for the working media 7. Due to the superposing of the axial direction of flow imposed by the stream of material and the rotational motion of the working media 7, in the direction, constant on average over time and generated by the rotating electromagnetic field 8, the constituents of the stream of material assume spiral paths in the working space of the annular-gap chamber 1. Consequently, the distance over which loading occurs is significantly longer than the axial dimension of the working space.

The throughflow path may be both from bottom to top, as in the first illustrative embodiment of the invention represented in FIGS. 1 and 2, and exclusively from the top via a plurality of restrictive guides in the working space or in the annular gap, as is the case in the second and third illustrative embodiments of the apparatus, which are represented in FIGS. 3, 4 and 5, 6 respectively.

The working of the material in the annular gap is performed by shear and impact loading of the constituents of the stream of material with respect to one another, with the working media 7 and with the walls of the annular-gap chamber 1.

The inlet 2 is a so-called double-tangential inlet, i.e., it goes over without rounding or bend directly into the annular gap, whereas the outlet 3 is designed in the form of a diffuser. In the inflow zone 13 and outflow zone 14, free from working media 7, a homogenization or reduction in the flow rate of the stream of material takes place.

During the working process, the working media 7 are drawn into the electromagnetically active working space of the annular-gap chamber 1 and held there by the electromagnetic field 8 and are consumed only very slowly by way of the wear taking place, without physical disturbances occurring in the flow of the material stream. To maintain limit values, i.e., to ensure process-engineering aspects of the working operation, a plurality of sensors are installed in the region of the material guide and on one of the exciter systems 4, 5.

For filling-level measurements, a filing-level measuring sensor 17 is arranged in the annular gap of the annular-gap chamber 1 near the bottom of the outflow zone 14. Temperature measurement is performed at the inlet 2 and outlet 3 of the stream of material and at the exciter windings **4*b*, 5*b* in the axial center with the aid of a pair of temperature measuring sensors 19 and 20, respectively, which supply control signals for cooling and for an alarm circuit (not shown), if predetermined limit values of the temperature in the material are exceeded. Furthermore, there are a pair of temperature measuring sensors 24, 25 for the exciter systems, which either alone or together with the temperature measuring sensors 19, 20** supply the control signals for cooling and for the alarm circuit as soon as the predetermined limit values of the temperature are exceeded.

For pressure measurement, a pressure measuring sensor 18 is arranged in the annular gap, which sensor activates a safety contact circuit in order to stop material being passed when inadmissibly high wall pressures are detected in the annular-gap chamber 1.

By a voltage measurement at a plurality of field coils 21 of the outer exciter system 4 with the aid of a volt meter 15, the quantity of active working media 7 in the annular gap can be determined.

The field coils 21 are arranged on the tooth ends of the outer exciter system 4. With the aid of these field coils, the induced voltage is measured and evaluated as a measure of the quantity of working media 7 in the multiphase mixture by the moving working media 7 in the electromagnetically active working space of the annular-gap chamber 1.

For material which is difficult to dispense, the arrangement of series-connected annular-gap chambers is provided, in order to avoid an extreme working length of a single annular-gap chamber, which would require complicated exciter systems and give rise to problems in cleaning.

For special preparation processes, material feeding and discharge exclusively from the top is possible in the second and third embodiments of the apparatus, as are shown in FIGS. 3 to 6. In these two illustrative embodiments of the apparatus, the same reference numerals are used for the same components as in the first illustrative embodiment according to FIGS. 1 and 2. In the illustrative embodiments, the exciter systems 4, 5 likewise comprise sheet assemblies **4*a*, 5*a*, which in each case bear a three-phase exciter winding 4*b*, 5*b* distributed in the slots and having the same number of pairs of poles. The inner and outer exciter systems 5 and 4, respectively, are conveniently likewise cast in solvent-resistant resins 9, so that they represent closed, installable elements. The inner exciter system 5 is in each case designed as a hollow shaft. The cylindrical free space within the inner exciter system 5** is designed for cooling by an air stream or by a forced circulating liquid cooling.

Figure 3:
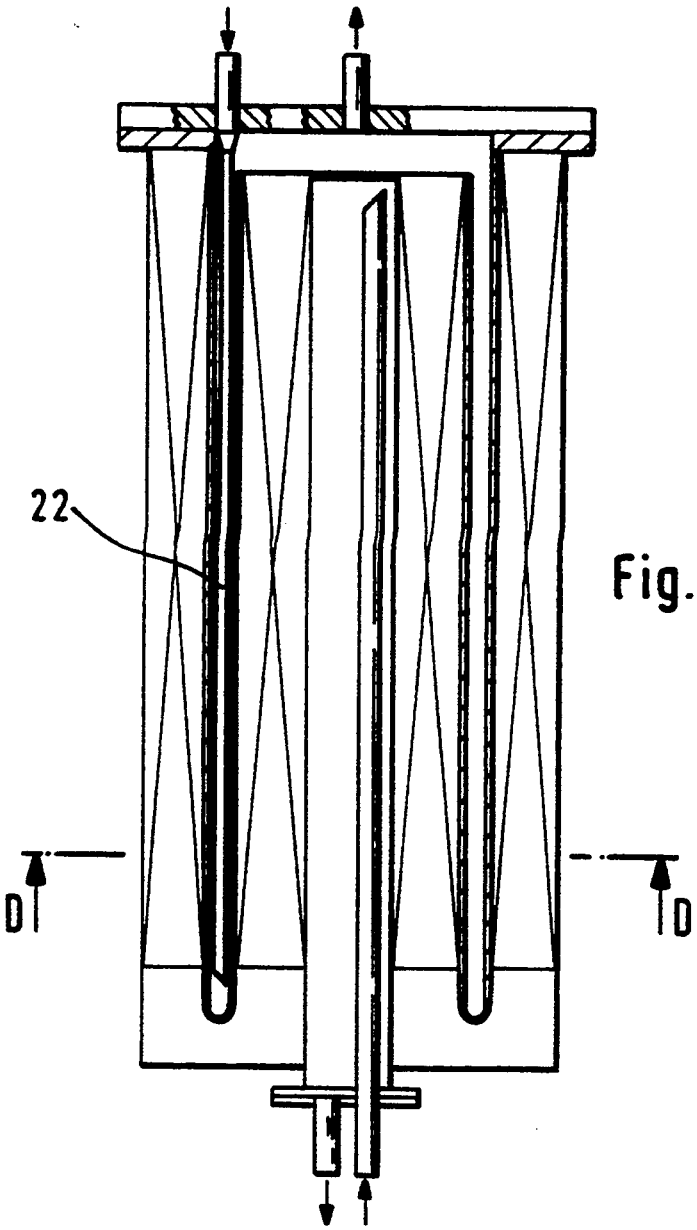
FIG. 3 shows a longitudinal section C—C of a second illustrative embodiment of the apparatus according to the invention, which is slightly modified in comparison with FIGS. 1 and 2.
Figure 4:
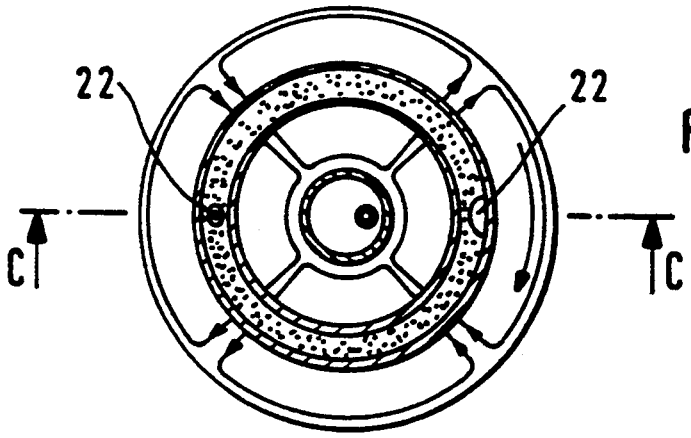
FIG. 4 shows a plan view in section D—D of the apparatus according to FIG. 3.

In the second illustrative embodiment, as shown in the sectional representations of FIGS. 3 and 4, a restrictive guide, projecting into the annular-gap chamber 1 from above, is fitted and extends until just above the bottom 16 of the annular-gap chamber 1. This restrictive guide is, for example, a cross-sectionally elliptical or half-round annular-gap tube 22, which bears against the outer wall of the annular-gap chamber 1 or terminates with it, and which adjoins the inlet 2. The minor axis of the elliptical tube 22 is smaller than the diameter of the inlet 2 and smaller than the width of the annular gap, which generally lies in the range from 10 to 40 mm, so that the circulation of the working media 7, constant on average over time, resulting from the rotating electromagnetic field 8 is scarcely disturbed. The desired flow cross-section of the annular-gap tube 22 is fixed by the major axis of the cross-section. Shown in FIG. 4 are both a tube 22 of elliptical cross-section and a tube 22 as half-tube, which terminates with the outer wall of the annular-gap chamber. The material flowing in through the inlet 2 is consequently guided within the annular gap in the annular-gap tube 22 and is not discharged into the working space of the annular-gap chamber 1 until at the bevelled lower end of the annular-gap tube 22. The material flowing thereafter then pushes the multiphase mixture within the annular gap from below upward in the direction of the outlet 3.

Similarly, a plurality of tubes 22 of elliptical cross-section, projecting into the annular-gap chamber 1, bearing against the inner side of the outer or inner wall of the annular-gap chamber and fed via a plurality of inlets 2 or by a suitable distributor system in the cover 11 via one inlet 2 can also be used. The annular-gap tube 22 is, for example, also designed as a half-tube, which then adjoins the inner side of the outer or inner wall of the annular-gap chamber 1 or is connected to the inner side.

The other elements of the second embodiment of the apparatus coincide with the corresponding elements of the first embodiment, so they are not described again.

Figure 5:
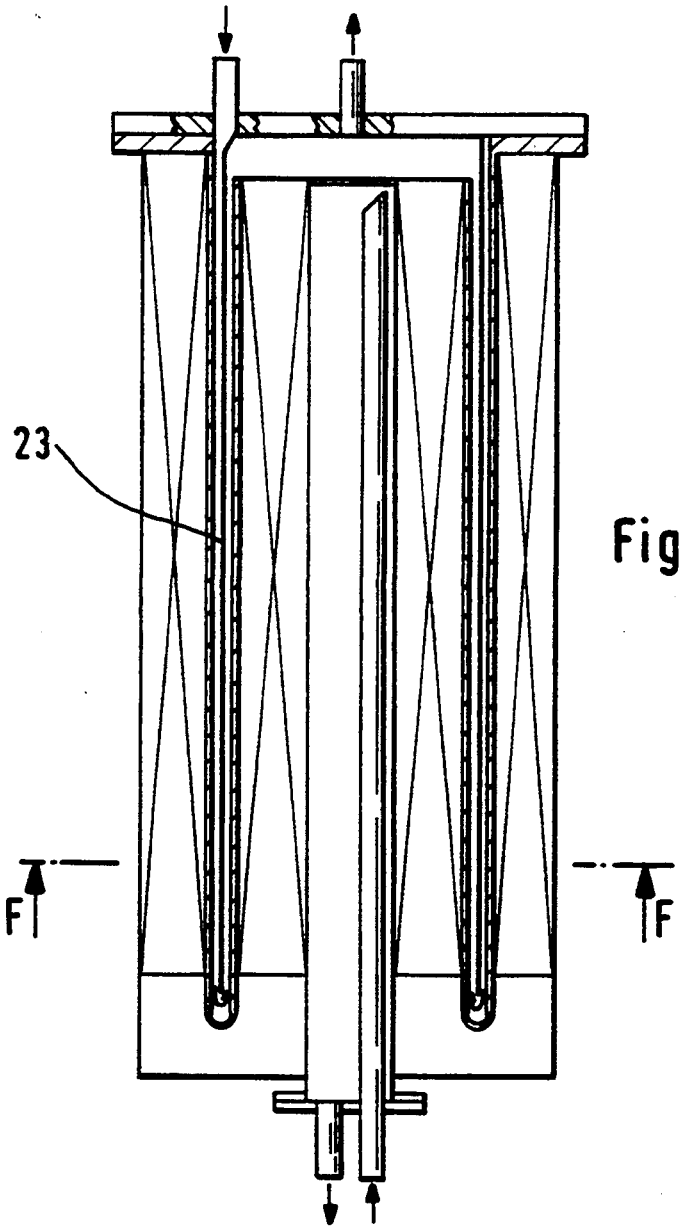
FIG. 5 shows a longitudinal section E—E of a third embodiment of the apparatus according to the invention which differs slightly from the two other embodiments.
Figure 6:
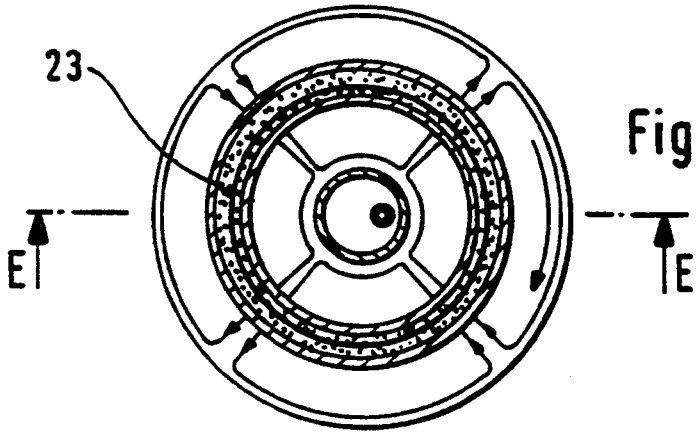
FIG. 6 shows a plan view in section F—F of the apparatus according to FIG. 5.

In the third embodiment of the apparatus, represented in FIGS. 5 and 6, just as in the second illustrative embodiment of the apparatus, the material is fed in and discharged from above. Instead of the material being passed through an elliptical annular-gap tube, in this embodiment the restrictive guidance of the material within the annular-gap chamber 1 is performed by means of a cylindrical annular wall 23, which projects from above into the enclosed annular-gap chamber 1 almost up to the end thereof. This annular wall 23 subdivides the annular-gap chamber into two sections, and consequently results in a doubling of the path of the material and hence in a particularly intensive preparation of the material. The annular wall 23 expediently passes centrally through the annular gap.

Similarly, it is possible, although not shown in the drawings, to arrange both the inlet and the outlet of the annular-gap chamber in the bottom and to provide corresponding restrictive guides as in the second and third illustrative embodiments of the apparatus in the annular gap.

In general, the annular-gap chamber 1 and the working media 7 are flushed by a flushing agent flowing continuously through the annular-gap chamber 1. During the flushing operation, the exciter systems are either operated at reduced power by means of economizing circuits of the exciter windings **4*b*, 5*b*** or one of the exciter systems is switched off, in order to achieve a slowed motion of the working media.

Similarly, it is possible to operate the working process discontinuously, that is to say to introduce the multiphase mixture discontinuously into the working space of the annular-gap chamber 1 and, after a working time set for a certain period, separate it from the working media, for example, with the aid of filters or screens, and discharge it from the working space.

While specific embodiments of the invention have been described and illustrated, it will be clear that variations in the details of the embodiments specifically illustrated and described may be made without departing from the true spirit and scope of the invention as defined in the appended claims.

What is claimed is:

1. An apparatus for reducing, dispersing, wetting and mixing pumpable, non-magnetic multiphase mixtures, comprising:

(a) an inner tube and an outer tube, said tubes being non-ferromagnetic and arranged so as to form an annular-gap chamber with an inflow zone and an outflow zone, an inlet and outlet, and a top and bottom, said chamber being hermetically sealed except for said inlet and said outlet;

(b) an outer exciter system surrounding said outer tube;

(c) an inner exciter system disposed within said inner tube;

(d) said inner and outer exciter systems being configured so as to create a plurality of electromagnetic fields which rotate in a common direction; and (e) a plurality of freely mobile magnetic working media contained in said annular-gap chamber and excluded from said inflow zone and said outflow zone.

2. An apparatus as set forth in claim 1, further comprising a central heat sink enclosed by said chamber, a cooling tube introduced into said heat sink, and means for flowing a fluid coolant through said cooling tube.

3. An apparatus as set forth in claim 2, wherein the annular-gap chamber comprises a unit which can be separated from the outer exciter system and can be removed from the outer exciter system to one side.

4. An apparatus as set forth in claim 2, wherein the annular-gap chamber comprises a unit which can be separated from the outer and inner exciter systems and can be removed from the inner and outer exciter systems to one side.

5. An apparatus for reducing, dispersing, wetting and mixing pumpable, non-magnetic multiphase mixtures, comprising:

(a) an inner tube and an outer tube, said tubes being non-ferromagnetic and arranged so as to form an annular-gap chamber with an inflow zone and an outflow zone, an inlet and outlet, and a top and bottom, said chamber being hermetically sealed except for said inlet and said outlet;

(b) an outer exciter system surrounding said outer tube;

(c) an inner exciter system disposed within said inner tube;

(d) said inner and outer exciter systems being configured so as to create a plurality of electromagnetic fields which rotate in a common direction; and (e) a plurality of freely mobile magnetic working media contained in said annular-gap chamber and excluded from said inflow zone and said outflow zone, wherein said outflow zone has a cross-section which increases in the direction of said outlet, said outlet is concentrically arranged and screen-free, said outflow zone is free from working media, goes over into the concentrically arranged, screen-free outlet, and further comprises a cover, through which the outlet is taken.

6. An apparatus as set forth in claim 1, further comprising an annular gap in the annular gap chamber, which has a width of 10 to 40 mm, and wherein the inner and outer exciters are closed and lie opposite each other at the annular gap, and wherein each of the exciter systems is rotationally symmetrical and comprises sheet assemblies of individual sheets and exciter windings, which are interconnected in such a way that, when fed with three-phase current, the annular gap is permeated radially by an electromagnetic field changing over time, which passes through in a tangential direction of the sheet assemblies.

7. An apparatus as set forth in claim 6, wherein the sheet assemblies further comprise punched sheets and in each case bear three-phase exciter windings distributed in a plurality of slots and have the same number of pairs of poles.

8. An apparatus as set forth in claim 6, wherein the sheet assemblies and exciter windings of each of the two exciter systems have been cast in solvent resistant resins or are impregnated with such resins.

9. An apparatus as set forth in claim 1, further comprising a plurality of temperature measuring sensors for temperature measurement of the exciter systems, and a plurality of temperature measuring sensors for determining the temperature provided at the inlet and at the outlet of the annular-gap chamber.

10. An apparatus as set forth in claim 1, further comprising a filling-level measuring sensor and a pressure measuring sensor for determining the multiphase mixture pressure in the annular-gap chamber, arranged in the annular gap chamber.

11. An apparatus as set forth in claim 1, further comprising a plurality of field coils arranged at ends of the outer exciter system, such that induced voltage is measured and evaluated by the magnetic working media moving in the electromagnetic fields of the annular-gap chamber.

12. An apparatus as set forth in claim 11, wherein the magnetic working media have a shape that is at least one of ball-shaped and barrel-shaped and are hard-magnetic material, of a diameter of from about 1 to 4 mm.

13. An apparatus as set forth in claim 11, wherein the magnetic working media has a density in the annular gap chamber of from about 40 to 90% by volume of the electromagnetic fields of the annular-gap chamber.

14. An apparatus as set forth in claim 1, further comprising a cover on the annular gap chamber, wherein the inlet is arranged in the bottom, and the outlet of the annular-gap chamber is arranged in the cover, and wherein a multiphase mixture flows from bottom to top through the annular-gap chamber without restrictive guidance.

15. An apparatus as set forth in claim 14, further comprising at least one annular-gap tube projecting into the annular-gap chamber.

16. An apparatus as set forth in claim 15, wherein each annular-gap tube has an elliptical cross-section and bears against the inner side of at least one of the inner and outer wall of the annular-gap chamber.

17. An apparatus as set forth in claim 15, wherein each annular-gap tube is a half-tube which is connected to the inner side of at least one of the inner or outer wall of the annular-gap chamber.

18. An apparatus as set forth in claim 1, further comprising a cover on the annular-gap chamber, wherein both the inlet and the outlet are arranged in the cover of the annular-gap chamber, in order respectively to feed in and discharge the multiphase mixture from the top.

19. An apparatus as set forth in claim 1, wherein both the inlet and the outlet are arranged in the bottom of the annular-gap chamber.

20. An apparatus as set forth in claim 1, wherein the outer and inner exciter systems comprise sheet assemblies which are formed from individual sheets and exciter windings.

21. An apparatus as set forth in claim 20, wherein the exciter windings and the sheet assemblies are cast in a solvent-resistant resin.

22. An apparatus as set forth in claim 1, further comprising a central heat sink enclosed by said chamber.

23. An apparatus as set forth in claim 1, wherein the working media comprises hexaferrites.

24. An apparatus as set forth in claim 1, wherein the working media comprises ball-shaped or barrel-shaped materials having a diameter or length, respectively, of from about 1 to 4 mm.

25. An apparatus as set forth in claim 1, wherein the packing density of the working media within the annular gap chamber lies in the range from 40 to 90% by volume.

26. An apparatus as set forth in claim 1, further comprising at least one annular-gap tube projecting into the annular-gap chamber.

27. An apparatus for reducing, dispersing, wetting and mixing pumpable, non-magnetic multiphase mixtures, comprising:

(a) an inner tube and an outer tube, said tubes being non-ferromagnetic and arranged so as to form an annular-gap chamber with an inflow zone and an outflow zone, an inlet and outlet, and a top and bottom, said chamber being hermetically sealed except for said inlet and said outlet;

(b) an outer exciter system surrounding said outer tube;

(c) an inner exciter system disposed within said inner tube;

(d) said inner and outer exciter systems being configured so as to create a plurality of electromagnetic fields which rotate in a common direction;

(e) a plurality of freely mobile magnetic working media contained in said annular-gap chamber;

(f) an electromagnetically active working space within said annular-gap chamber wherein said freely mobile magnetic working media are caused to move in an approximately chaotic manner on endless paths at a rate which is constant over time along one of the electromagnetic fields generated by said exciter systems; and (g) wherein said outflow zone has a cross-section which increases in the direction of said outlet, said outlet is concentrically arranged and screen-free, said outflow zone is free from working media, goes over into the concentrically arranged, screen-free outlet, and further comprises a cover, through which the outlet is taken.

* * * * *